US009376815B1

(12) United States Patent
Santini

(10) Patent No.: US 9,376,815 B1
(45) Date of Patent: Jun. 28, 2016

(54) STRUCTURAL CONCRETE PANEL

(71) Applicant: Patrick J. Santini, West Bend, WI (US)

(72) Inventor: Patrick J. Santini, West Bend, WI (US)

( * ) Notice: Subject to any disclaimer, the term of this patent is extended or adjusted under 35 U.S.C. 154(b) by 0 days.

(21) Appl. No.: 14/814,670

(22) Filed: Jul. 31, 2015

(51) Int. Cl.
*E04C 2/52* (2006.01)
*E04C 2/30* (2006.01)
*E04C 2/06* (2006.01)

(52) U.S. Cl.
CPC ... *E04C 2/30* (2013.01); *E04C 2/06* (2013.01); *E04C 2/521* (2013.01); *E04B 2103/02* (2013.01); *E04B 2103/06* (2013.01)

(58) Field of Classification Search
CPC ..... E04C 2/06; E04C 2/28; E04C 5/10; E04C 2002/002
See application file for complete search history.

(56) References Cited

U.S. PATENT DOCUMENTS 3,378,971 A * 4/1968 Singer ..... E04B 1/185 52/236.7
4,012,153 A * 3/1977 Pidgeon ..... F16B 7/185 403/170
4,606,165 A * 8/1986 Allan ..... E04B 1/04 403/170
5,596,853 A * 1/1997 Blaney ..... E04C 2/044 52/223.7
2013/0157491 A1* 6/2013 Chavan ..... H02G 1/00 439/210
2014/0137727 A1* 5/2014 Riley ..... E04C 2/06 89/36.02
2014/0308079 A1* 10/2014 Hamrick ..... E04C 2/06 405/153

* cited by examiner

*Primary Examiner* — Patrick Maestri
(74) *Attorney, Agent, or Firm* — Donald J. Ersler

(57) ABSTRACT

A structural concrete panel preferably includes six connector boxes, a plurality of conduits, a plurality of rebar rods, a plurality of insulation blocks, a plurality of rebar mesh sheets and a concrete outer layer. Four corner connector boxes are located in each corner of the structural concrete panel. A side connector box is located between two corner connector boxes on each side of the structural concrete panel. Each end of a plurality of rebar rods are secured to two adjacent connector boxes. Two bottom rebar mesh sheets are retained on a bottom of the structural concrete panel. The plurality of insulation blocks are laid on the two bottom rebar mesh sheets. Two top rebar mesh sheets are retained on a top of the structural concrete. Concrete is molded around the plurality of rebar mesh sheets, the plurality of rebar rods and the plurality of insulation blocks.

19 Claims, 8 Drawing Sheets

STRUCTURAL CONCRETE PANEL

BACKGROUND OF THE INVENTION

1. Field of the Invention

The present invention relates generally to buildings and more specifically to a structural concrete panel, which may be used to create floors, walls and ceilings in construction of a building.

2. Discussion of the Prior Art

It appears that the prior art does not disclose a structural concrete panel.

Accordingly, there is a clearly felt need in the art for a structural concrete panel, which may be attached to adjacent structural concrete panels to create floors, walls and ceilings in construction of a building.

SUMMARY OF THE INVENTION

The present invention provides a structural concrete panel, which may be used to create floors, walls and ceilings in construction of a building. The structural concrete panel preferably includes six connector boxes, a plurality of conduits, a plurality of rebar rods, a plurality of insulation blocks, a plurality of rebar mesh sheets and a concrete outer layer. Four corner connector boxes are located in each corner of the structural concrete panel. Each corner connector box includes an access opening formed through a top and a bottom; two conduit holes formed through two adjacent sides; a plurality of rebar rod holes are formed through the two adjacent sides; and attachment holes are formed through two opposing adjacent sides. A side connector box is located between two corner connector boxes on each side of the structural concrete panel. Each side connector box includes an access opening formed through a top and a bottom; three conduit holes formed through three adjacent sides; a plurality of rebar rod holes are formed through the three adjacent sides; and attachment holes are formed through a remaining side. Each end of one of the conduits is secured in a conduit hole in two adjacent connector boxes. Each end of a plurality of rebar rods is secured in the plurality rebar holes in two adjacent connector boxes. Two bottom rebar mesh sheets are retained on a bottom of the structural concrete panel by tying the two bottom mesh sheets to the plurality of rebar rods. The plurality of insulation blocks are laid on the two bottom rebar mesh sheets. Two top rebar mesh sheets are retained on a top of the structural concrete panel by tying the two top mesh sheets to the plurality rebar rods. Concrete is molded around the plurality of rebar mesh sheets, plurality of insulating blocks and the plurality of rebar rods.

Accordingly, it is an object of the present invention to provide a structural concrete panel, which may be attached to adjacent structural concrete panels to form floors, walls and ceilings in construction of a building.

These and additional objects, advantages, features and benefits of the present invention will become apparent from the following specification.

DETAILED DESCRIPTION OF THE PREFERRED EMBODIMENTS

Figure 1:
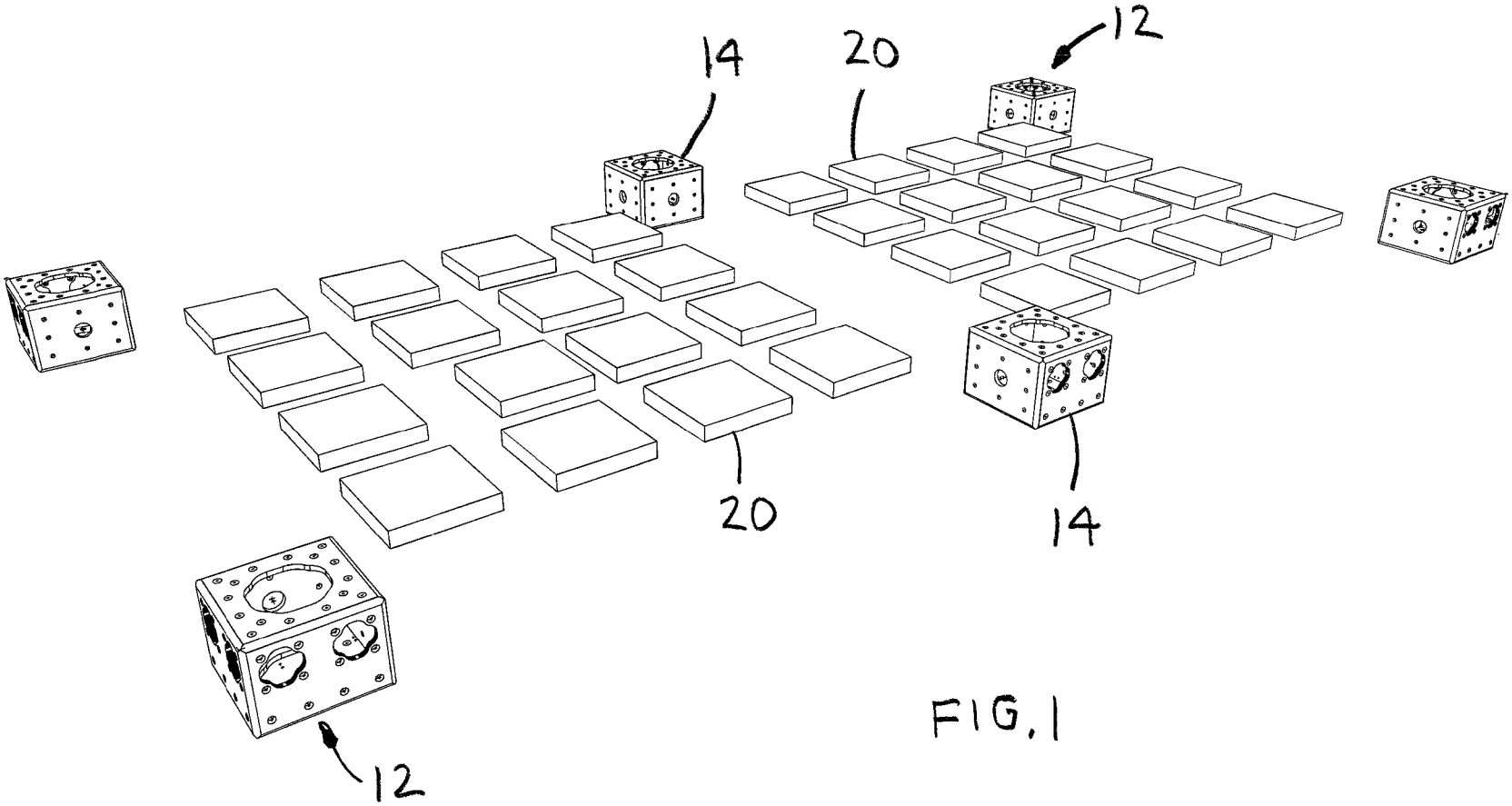
FIG. 1 is a perspective view of a plurality of connector boxes and insulation blocks positioned for assembly of a structural concrete panel in accordance with the present invention.
Figure 2:
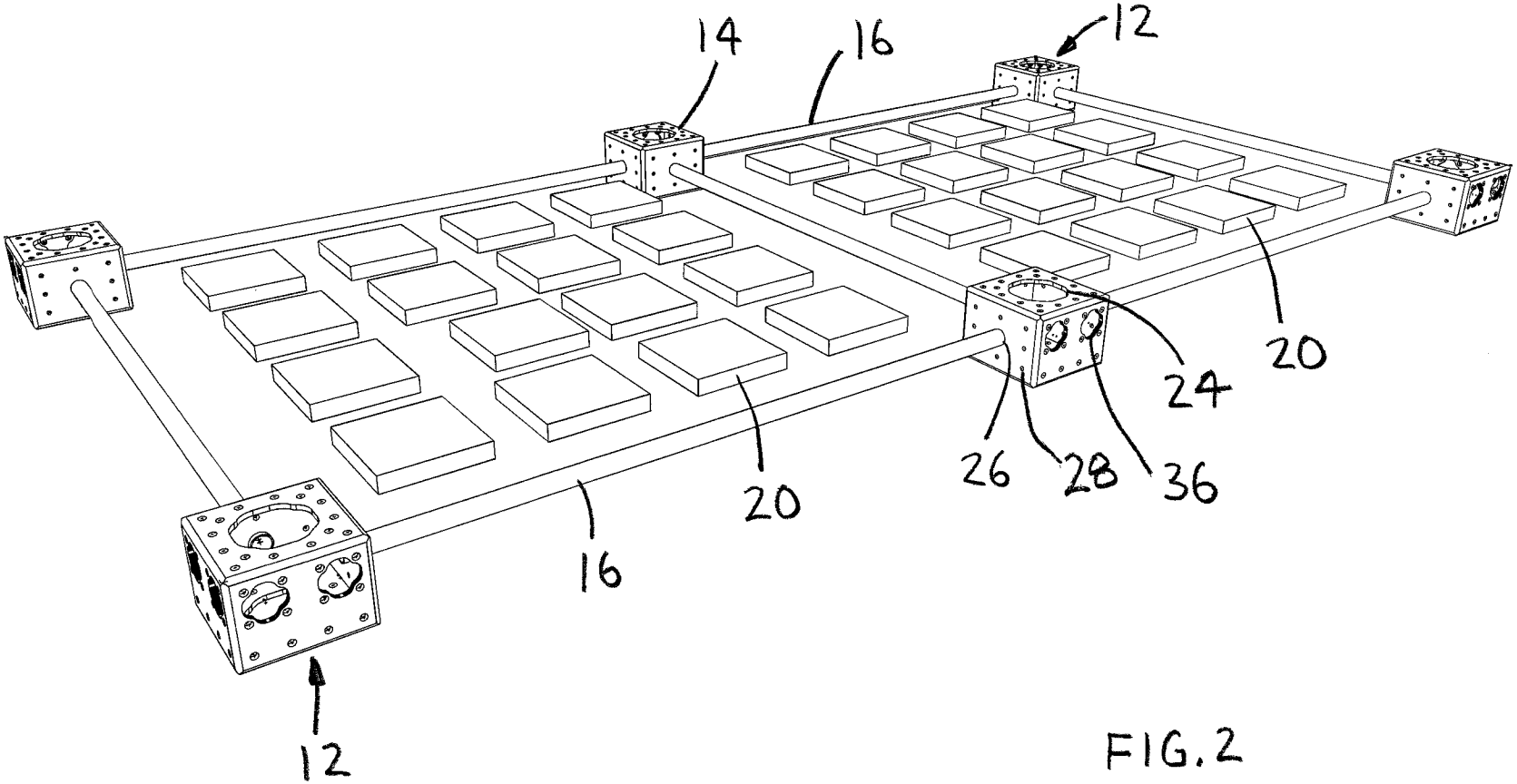
FIG. 2 is a perspective view of a plurality of conduits secured between adjacent connector boxes of a structural concrete panel in accordance with the present invention.
Figure 3:
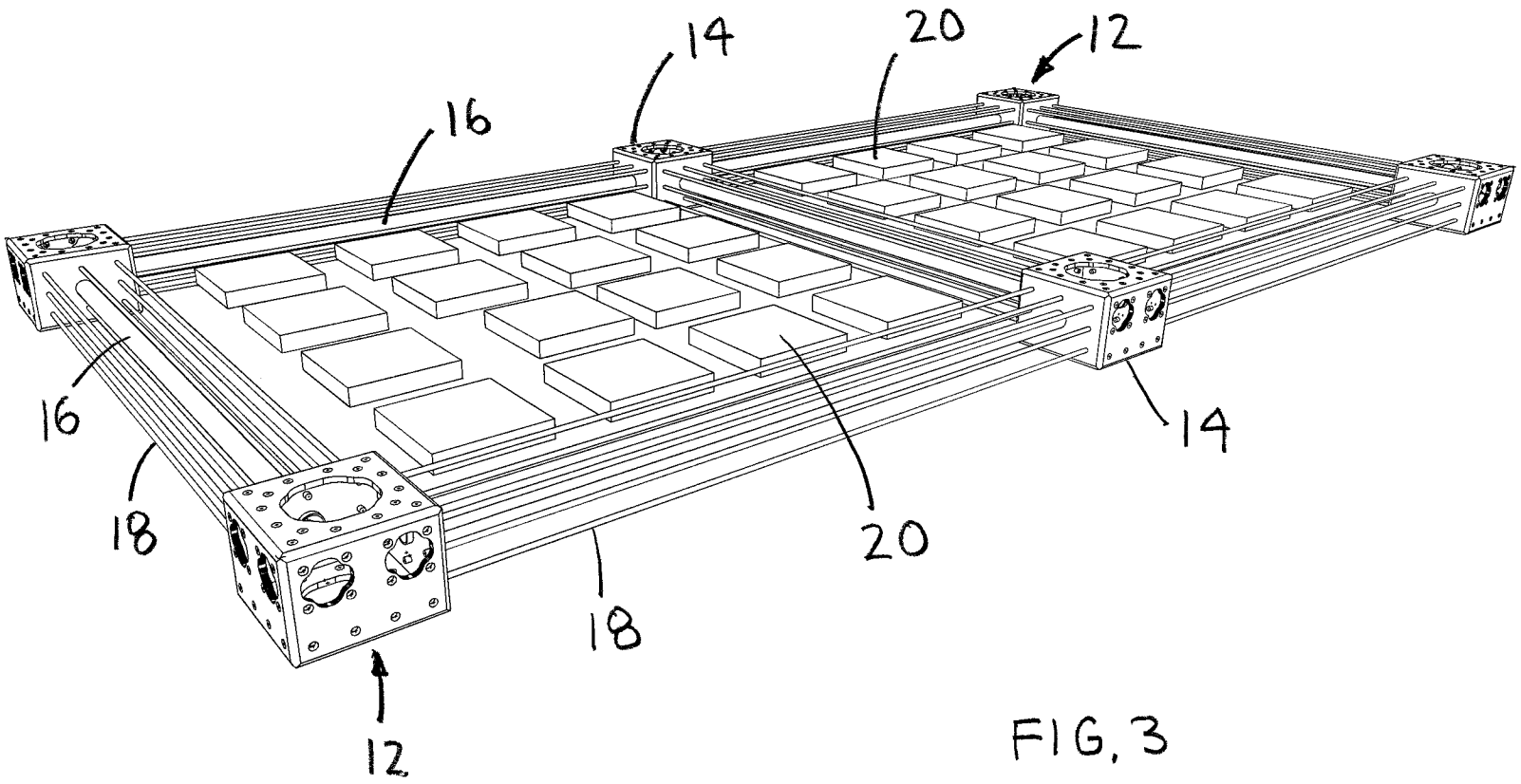
FIG. 3 is a perspective view of a plurality of rebar rods secured between adjacent connector boxes of a structural concrete panel in accordance with the present invention.
Figure 4:
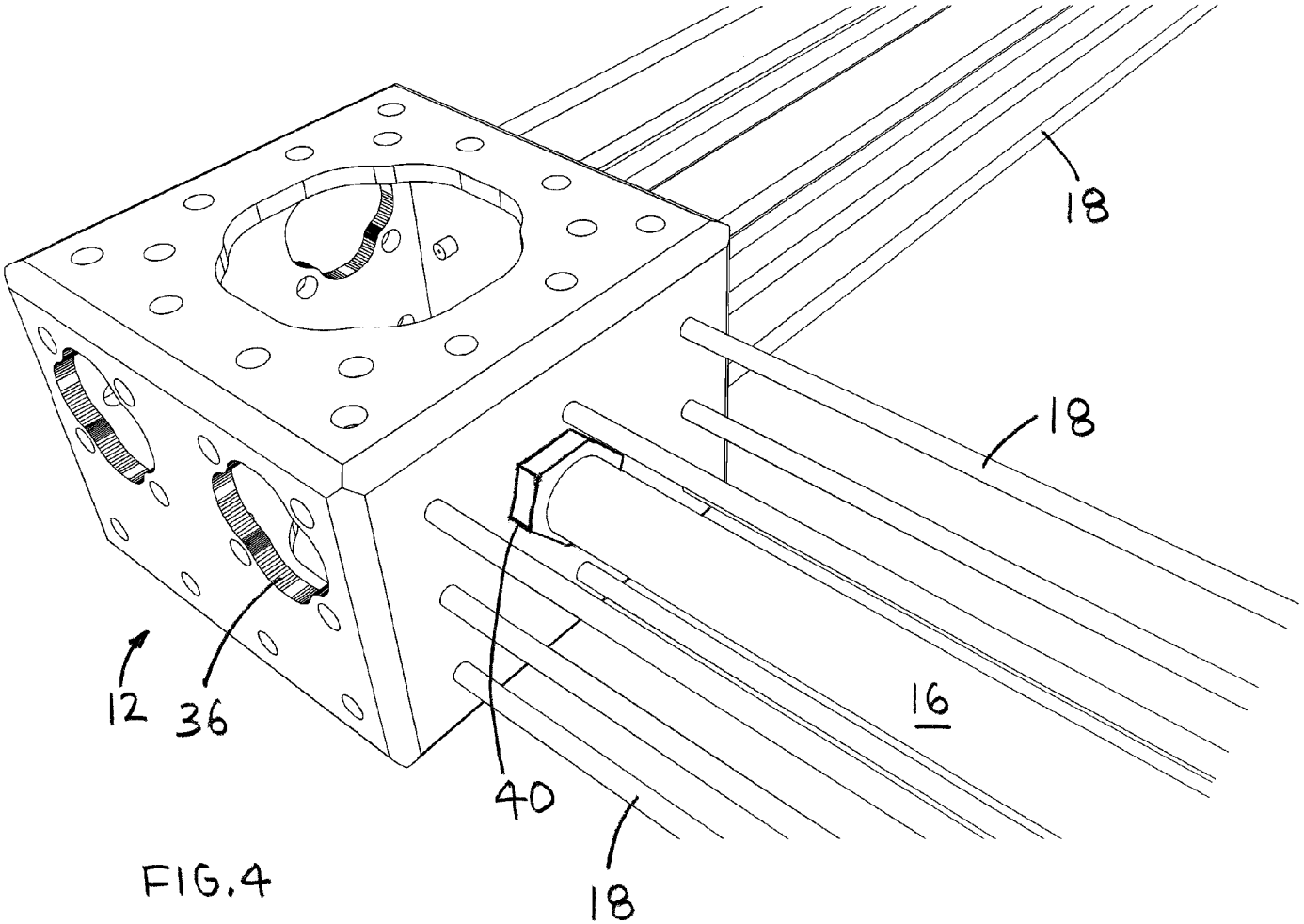
FIG. 4 is an enlarged perspective view of a conduit and a plurality of rebar rods secured to a corner connector box of a structural concrete panel in accordance with the present invention.
Figure 5:
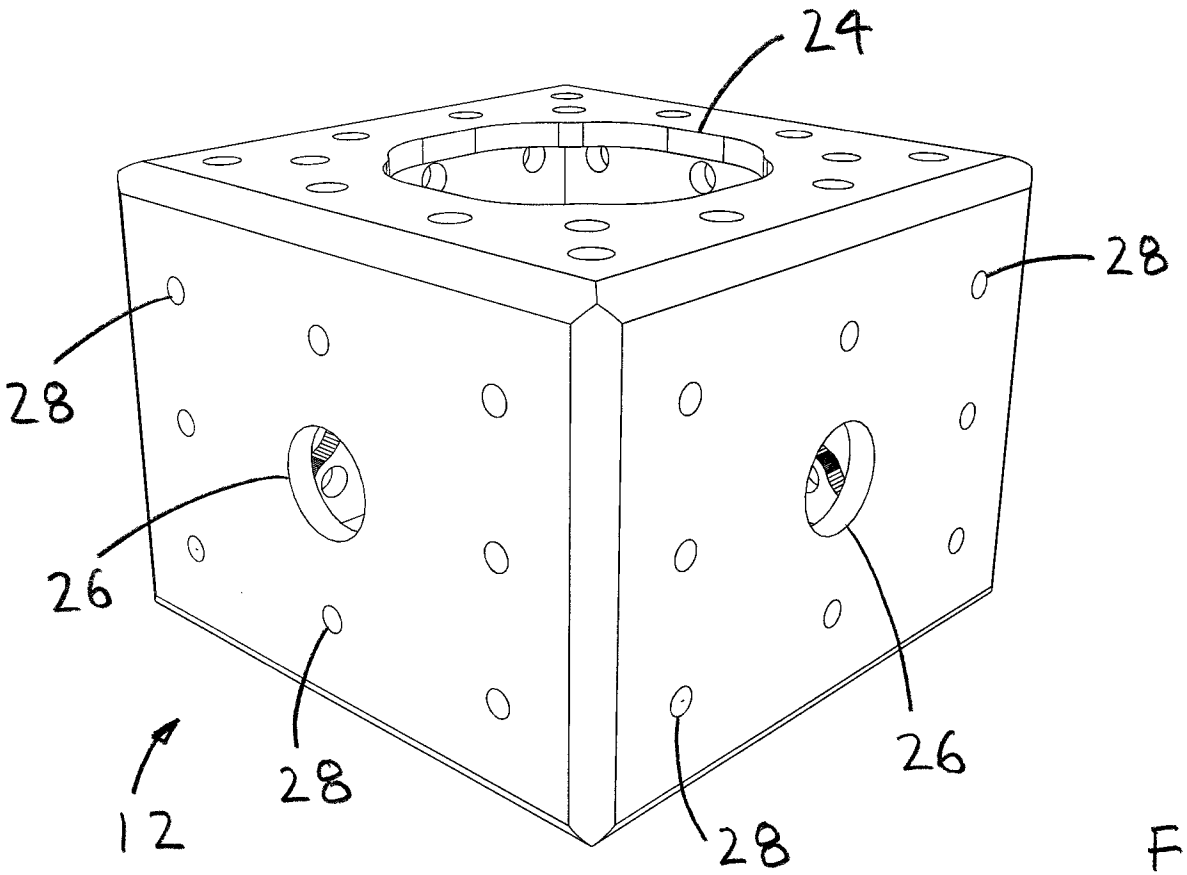
FIG. 5 is an enlarged perspective view of a corner connector box rotated 90 degrees clockwise from that shown in FIG. 4 of a structural concrete panel in accordance with the present invention.
Figure 6:
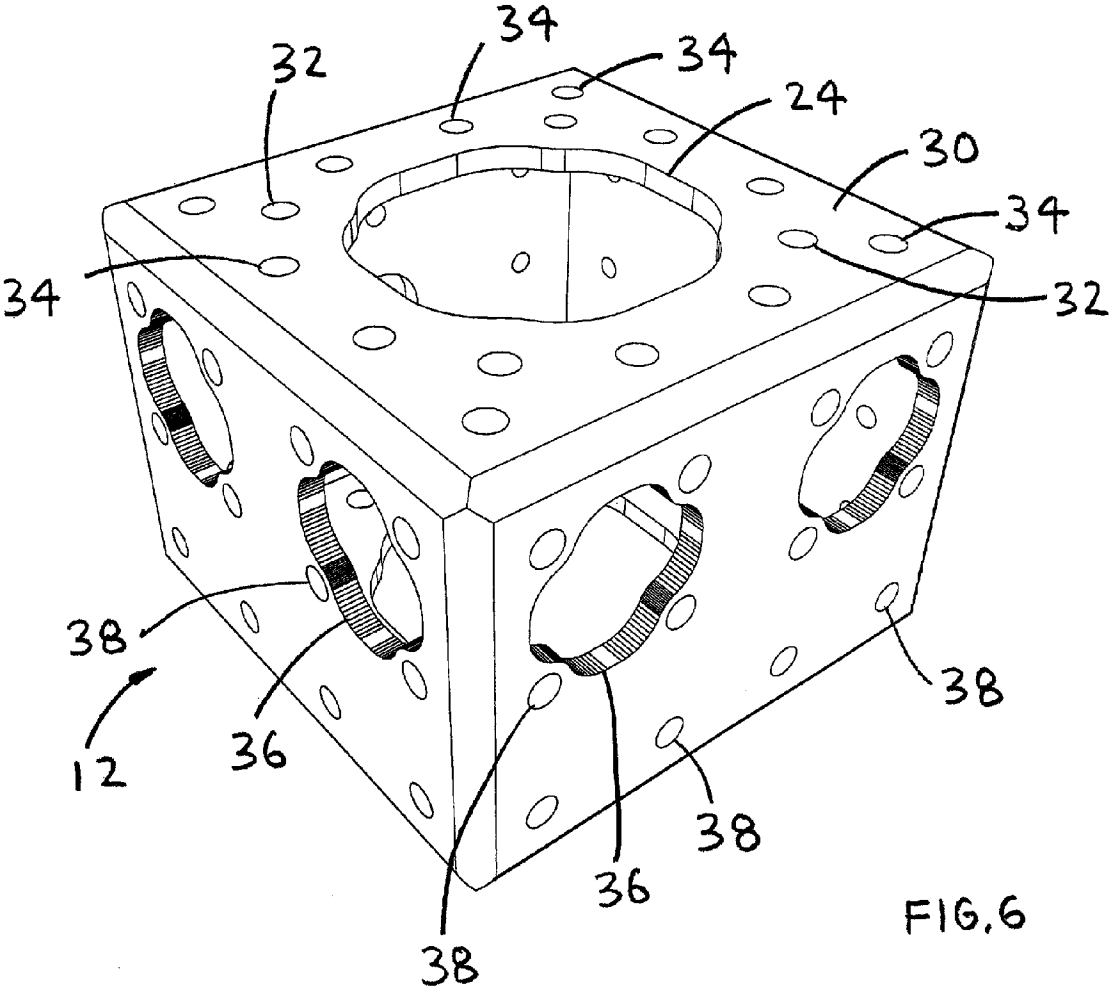
FIG. 6 is an enlarged perspective view of a corner connector box of a structural concrete panel in accordance with the present invention.
Figure 7:
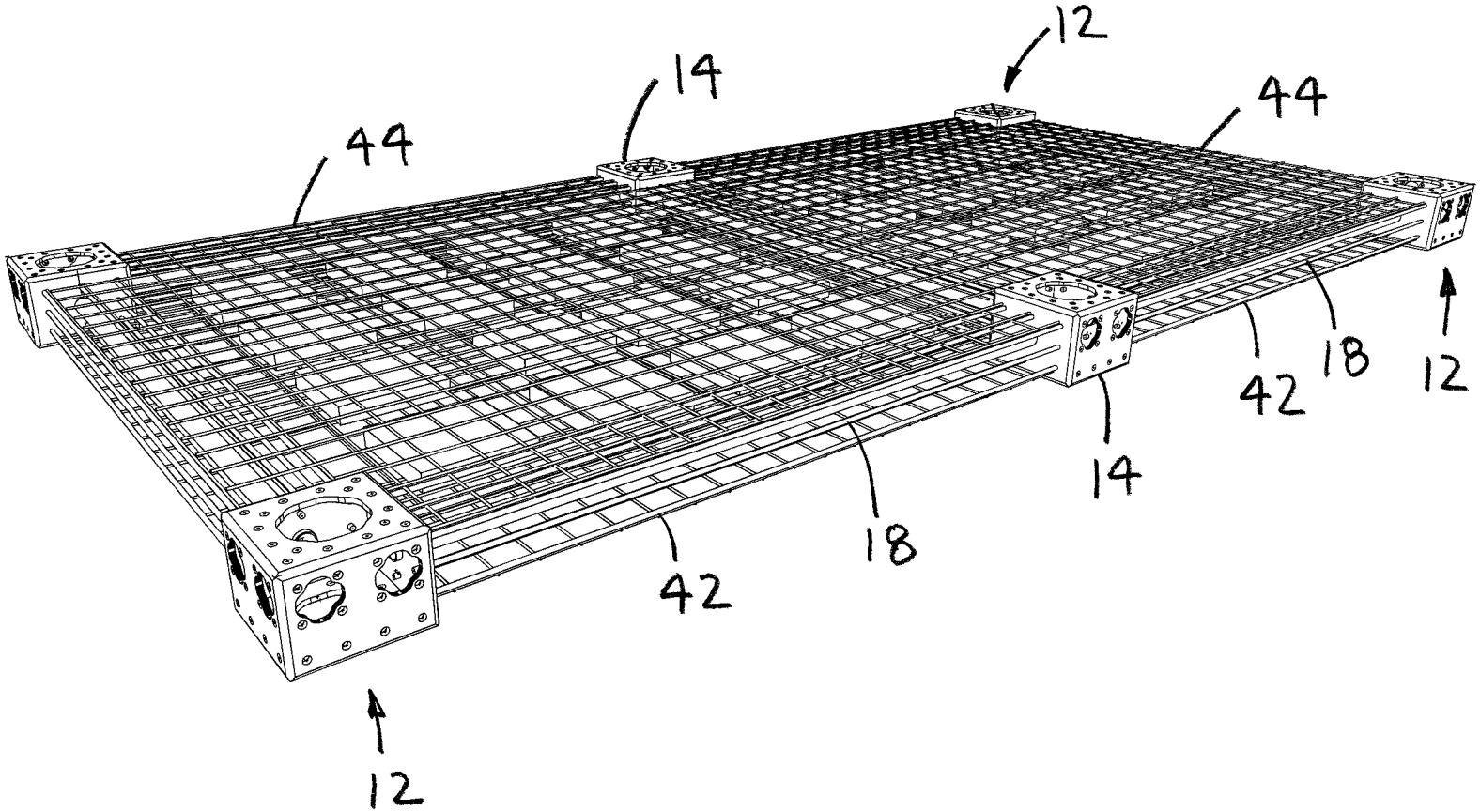
FIG. 7 is a perspective view of two top rebar mesh sheets and two bottom rebar mesh sheets secured to a plurality of rebar rods of a structural concrete panel in accordance with the present invention.
Figure 8:
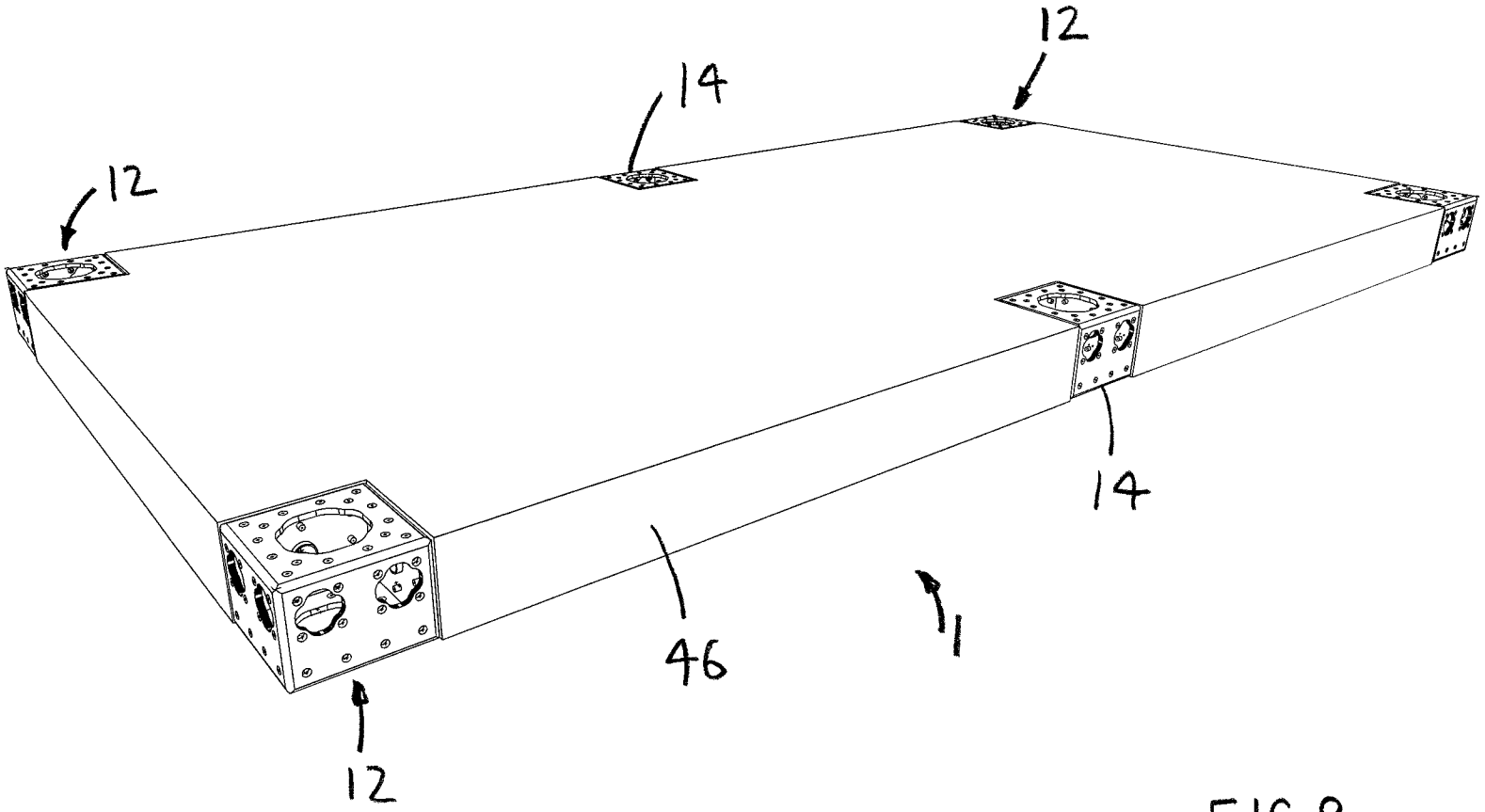
FIG. 8 is a perspective view of a completed structural concrete panel in accordance with the present invention.

With reference now to the drawings, and particularly to FIG. 8, there is shown a perspective view of a structural concrete panel 1. With reference to FIGS. 1-4 and 7, the structural concrete panel 1 preferably includes six connector boxes 12, 14, a plurality of conduits 16, a plurality of rebar rods 18, a plurality of insulation blocks 20, a plurality of rebar mesh sheets and a concrete outer layer. Four corner connector boxes 12 are located in each corner of the structural concrete panel 1. A side connector box 14 is located between two corner connector boxes 12 on each side of the structural concrete panel 1. With reference to FIGS. 5-6, each corner connector box 12 preferably includes a rectangular shape, an access opening 24 formed through a top and a bottom; two conduit holes 26 formed through two adjacent sides; and a plurality of rebar rod holes 28 are formed through the two adjacent sides. A fastener hole pattern 30 is formed around the access opening 24. The fastener hole pattern 30 includes four inner perimeter fastener holes 32 preferably arraigned in a rectangular pattern and ten outer perimeter fastener holes 34 preferably arraigned in a rectangular pattern.

A plurality of access openings 36 are formed through two opposing adjacent sides of the corner box 12. A plurality of fastener holes 38 are formed through the two opposing adjacent sides. Each side connector box 14 includes an access opening 24 formed through a top and a bottom; three conduit holes 26 formed through three adjacent sides; a plurality of rebar rod holes 28 are formed through the three adjacent sides; and attachment holes 36 are formed through a remaining side. With reference to FIG. 4, each end of one of the plurality of the conduits 16 are preferably secured in the conduit holes 26 in two adjacent connector boxes 12, 14 with a conduit fitting 40. Each end of a plurality of rebar rods 18 are preferably secured in the plurality rebar holes 28 in two adjacent connector boxes 12, 14 with welding or the like. The diameter of the rebar rods 18 and the rebar rod holes 28 may be varied, depending upon load requirements.

With reference to FIG. 7, two bottom rebar mesh sheets 42 are retained on a bottom of the structural concrete panel 1 by tying the two bottom mesh sheets 42 to the plurality of rebar rods 18. The plurality of insulation blocks 20 are laid on the two bottom rebar mesh sheets 42. Two top rebar mesh sheets 44 are retained on a top of the structural concrete panel 1 by tying the two top mesh sheets 44 to the plurality rebar rods 18. With reference to FIG. 8, concrete 46 is molded around the plurality of rebar mesh sheets 42, 44 and the plurality of rebar rods 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A structural concrete panel comprising:

four corner connector boxes, each said corner connector box includes six inner walls, at least one access opening is formed through one of said inner walls, a plurality of fasteners holes are formed around a perimeter of said at least one access opening, wherein at least one fastener is capable of being inserted through at least one of said plurality of fastener holes in a first structural concrete panel and at least one of said plurality of fastener holes in a second structural concrete panel to secure the first and second structural concrete panels to each other;

each one of a plurality of conduits have opposing ends retained by conduit holes in and inner wall of two corner connector boxes; and concrete is molded over said plurality of conduits.

2. The structural concrete panel of claim 1 wherein:

each one of said four corner connector boxes includes a rectangular shape, said at least one access opening is formed through a top and a bottom of each one of said four corner connector boxes.

3. The structural concrete panel of claim 2 wherein:

a fastener hole pattern is formed around said at least one access opening, said fastener hole pattern includes four inner perimeter fastener holes and ten outer perimeter fastener holes arranged in a rectangular pattern.

4. The structural concrete panel of claim 1 wherein:

two conduit holes of a plurality of conduit holes are formed through two adjacent inner walls of each one of said four corner connector boxes.

5. The structural concrete panel of claim 2 wherein:

a plurality of second access openings are formed through two adjacent inner walls of each one of said four corner connector boxes, said plurality of fastener holes are formed through said same adjacent sides.

6. A structural concrete panel comprising:

four corner connector boxes, each said corner connector box includes six inner walls, a plurality of fastener holes are formed through said inner walls, at least one access opening is formed through one of said at least four inner walls, some of said plurality of fasteners holes are formed around a perimeter of said at least one access opening, wherein at least one fastener is capable of being inserted through at least one of said plurality of fastener holes in a first structural concrete panel and at least one of said plurality of fastener holes in a second structural concrete panel to secure the first and second structural concrete panels to each other;

each one of a plurality of conduits have opposing ends retained by two adjacent connector boxes of said plurality of connector boxes; and a plurality of rebar rods concrete is molded over said plurality of rebar rods.

7. The structural concrete panel of claim 6 wherein:

said four connector boxes include a rectangular shape, said at least one access opening is formed through a top and a bottom of each one of said four connector boxes.

8. The structural concrete panel of claim 7 wherein:

a fastener hole pattern is formed around said at least one access opening, said fastener hole pattern includes four inner perimeter fastener holes and ten outer perimeter fastener holes arranged in a rectangular pattern.

9. The structural concrete panel of claim 6 wherein:

two conduit holes of a plurality of conduit holes are formed through two adjacent sides of each one of said four corner connector boxes, a plurality of rebar rod holes are formed through said two adjacent sides of each one of said four corner connector boxes.

10. The structural concrete panel of claim 7 wherein:

a plurality of second access openings are formed through two adjacent sides of each one of said four corner connector boxes, said plurality of fastener holes are formed through said adjacent sides.

11. The structural concrete panel of claim 6 wherein:

at least one rebar mesh sheet is tied to said plurality of rebar rods.

12. A structural concrete panel comprising:

four corner connector boxes, each said connector box includes six inner walls, a plurality of fastener holes are formed through said at least four inner walls, at least one access opening is formed through one of said at least four inner walls, some of said plurality of fasteners holes are formed around a perimeter of said at least one access opening, wherein at least one fastener is capable of being inserted through at least one of said plurality of fastener holes in a first structural concrete panel and at least one of said plurality of fastener holes in a second structural concrete panel to secure the first and second structural concrete panels to each other;

each one of a plurality of conduits have opposing ends retained by conduit holes in an inner wall of two adjacent connector boxes of said plurality of connector boxes;

each one of a plurality of rebar rods have opposing ends retained by two adjacent connector boxes of said plurality of connector boxes; and concrete is molded over said plurality of rebar rods and said plurality of conduits.

13. The structural concrete panel of claim 12 wherein:

said plurality of connector boxes include a rectangular shape, said at least one access opening is formed through a top and a bottom of each one of said four connector boxes.

14. The structural concrete panel of claim 13 wherein:

a fastener hole pattern is formed around said at least one access opening, said fastener hole pattern includes four inner perimeter fastener holes and ten outer perimeter fastener holes arranged in a rectangular pattern.

15. The structural concrete panel of claim 12 wherein:

two conduit holes are formed through two adjacent sides of each one of said at least four corner connector boxes, a plurality of rebar rod holes are formed through said two adjacent sides of each one of said four corner connector boxes.

16. The structural concrete panel of claim 13 wherein:

a plurality of second access openings are formed through two adjacent sides of each one of said four corner connector boxes, a plurality of fastener holes are formed through said adjacent sides.

17. The structural concrete panel of claim 12 wherein:

at least one rebar mesh sheet is tied to said plurality of rebar rods.

18. The structural concrete panel of claim 1 wherein:

at least one insulating block is retained in said structural concrete panel.

19. The structural concrete panel of claim 6 wherein:

at least one insulating block is retained in said structural concrete panel.

* * * * *